US009186540B2

(12) United States Patent
Bass et al.

(10) Patent No.: US 9,186,540 B2
(45) Date of Patent: Nov. 17, 2015

(54) SELF-ADJUSTING SKEWER CLAMP FOR A BICYCLE TRAINER

(71) Applicant: Saris Cycling Group, Inc., Madison, WI (US)

(72) Inventors: Benjamin R. Bass, Madison, WI (US); Mark A. Dahl, Rice Lake, WI (US)

(73) Assignee: Saris Cycling Group, Inc., Madison, WI (US)

( * ) Notice: Subject to any disclaimer, the term of this patent is extended or adjusted under 35 U.S.C. 154(b) by 102 days.

(21) Appl. No.: 14/043,029

(22) Filed: Oct. 1, 2013

(65) Prior Publication Data

US 2014/0094348 A1 Apr. 3, 2014

Related U.S. Application Data

(60) Provisional application No. 61/708,321, filed on Oct. 1, 2012.

(51) Int. Cl.
*A63B 69/16* (2006.01)
*A63B 22/06* (2006.01)

(52) U.S. Cl.
CPC ..... *A63B 22/0605* (2013.01); *A63B 69/16* (2013.01); *A63B 2069/165* (2013.01); *A63B 2225/09* (2013.01)

(58) Field of Classification Search
CPC .... A63B 22/06; A63B 22/0605; A63B 69/16; A63B 2069/161–2069/168
See application file for complete search history.

(56) References Cited

U.S. PATENT DOCUMENTS

| | | | |
|---|---|---|---|
| 3,724,844 | A | 4/1973 | Olmstead |
| 3,735,981 | A | 5/1973 | Mallin |
| 4,082,308 | A | 4/1978 | Hug |
| 4,262,899 | A | 4/1981 | Alvarez |
| 4,322,070 | A | 3/1982 | Jordaan |
| 4,421,308 | A | 12/1983 | Nagy |
| 4,505,473 | A | 3/1985 | Pro |
| 4,572,502 | A | 2/1986 | Messineo |
| 4,648,597 | A | 3/1987 | Adler |
| 4,768,782 | A | 9/1988 | Blackburn |
| 4,941,651 | A | 7/1990 | Phillips |
| 4,955,600 | A | 9/1990 | Hoffenberg et al. |
| 4,969,642 | A | 11/1990 | Phillips |

(Continued)

FOREIGN PATENT DOCUMENTS

WO 9902391 1/1999

OTHER PUBLICATIONS

"CycleOps Owner's Manual for the FLUID2, MAGNETO, MAG, MAG+, and WIND Trainers", 14914D, Jul. 2006, 8 pages.

*Primary Examiner* — Oren Ginsberg
(74) *Attorney, Agent, or Firm* — Boyle Fredrickson, S.C.

(57) ABSTRACT

A self-adjusting bolt action skewer clamp for a bicycle trainer includes a hollow, outer support member and an inner engagement member located inside the support member. The support member has a helical slot with a pocket at one end. The inner engagement member is attached to a handle via a carrier contained within a passage defined by the inner engagement member, and the handle can slide within the helical slot such that the inner engagement member will extend past the support member as the handle is rotated around the helical slot. Once it reaches the pocket, the handle will remain locked in place. The clamp tightens onto a rear axle of the bicycle. The spring allows the bicycle trainer to accommodate bicycles of various sizes without adjustment.

14 Claims, 4 Drawing Sheets

(56) References Cited

U.S. PATENT DOCUMENTS

| | | | |
|---|---|---|---|
| 5,026,047 | A | 6/1991 | Kosecoff |
| 5,042,795 | A | 8/1991 | Bursik |
| 5,145,478 | A | 9/1992 | Minoura |
| 5,152,729 | A | 10/1992 | Phillips |
| 5,397,285 | A | 3/1995 | Haan et al. |
| 5,417,629 | A | 5/1995 | Phipps |
| 5,433,681 | A | 7/1995 | Minoura |
| 5,628,711 | A | 5/1997 | Boucher |
| 5,728,029 | A | 3/1998 | Minoura |
| 5,916,067 | A | 6/1999 | Morasse |
| 6,019,708 | A | 2/2000 | Kaminski et al. |
| 6,203,472 | B1 | 3/2001 | McCaffrey et al. |
| 6,620,081 | B2 | 9/2003 | Phillips |
| 6,659,917 | B1 | 12/2003 | Tacx |
| 6,736,761 | B2 | 5/2004 | Huang |
| 7,407,466 | B2 | 8/2008 | Chiu |
| 7,442,152 | B2 | 10/2008 | Peterson et al. |
| 7,481,748 | B2 | 1/2009 | Schroeder |
| 7,758,474 | B1 | 7/2010 | Pedrini |
| 8,006,945 | B2 | 8/2011 | Chen |
| 8,029,419 | B2 | 10/2011 | Wan |
| 8,147,388 | B2 | 4/2012 | Bingham et al. |
| 2001/0041648 | A1 | 11/2001 | Schroeder |
| 2004/0053751 | A1 | 3/2004 | Pizolato |
| 2007/0142184 | A1 | 6/2007 | Schroeder |
| 2009/0075785 | A1 | 3/2009 | Schroeder |

SELF-ADJUSTING SKEWER CLAMP FOR A BICYCLE TRAINER

CROSS-REFERENCE TO RELATED APPLICATION

This application claims priority under 35 U.S.C. §119 based on U.S. Provisional Patent Application No. 61/708,321, which was filed on Oct. 1, 2012, the subject matter of which is incorporated by reference in its entirety.

BACKGROUND OF THE INVENTION

1. Field of the Invention

The present invention relates in general to the field of stationary bicycle trainers. More particularly, the present invention relates to the bolt mechanism that holds a bicycle in place on a bicycle trainer by clamping onto the bicycle axle or skewer.

2. Discussion of the Related Art

There are several types of bicycle trainers that hold a bicycle in a stationary position relative to a frame. These bicycle trainers employ a number of different mechanisms to secure the bicycle to the bicycle trainer, typically by clamping the ends of the bicycle skewer or axle. For instance, the bicycle skewer may be engaged by a mounting bolt that can be actuated to move toward and away from a stationary receiver. The position of the receiver must be adjusted in order to accommodate the specific distance between the ends of the skewer. Alternatively, a lead screw may be employed to move a clamping member toward and away from a stationary receiver. The lead screw actuator must be turned repeatedly in order to travel toward and away from the receiver to engage and disengage the skewer, respectively. Arrangements such as this are time-consuming and inconvenient when securing a bicycle wheel to a bicycle trainer or removing a bicycle from a bicycle trainer.

What is needed, therefore, is a securing mechanism that can easily be used to engage the axle or skewer of a variety of different types and styles of bicycles in a quick and convenient manner.

BRIEF DESCRIPTION OF THE INVENTION

By way of summary, the present invention is a self-adjusting bolt action skewer clamping mechanism capable of engaging the bicycle axle or skewer of a number of different types, sizes and styles of bicycle in a quick and easy manner.

In accordance with a first aspect of the invention, one side of the self adjusting bolt action skewer clamp mechanism in accordance with the present invention is configured to be fixed in a stationary position. The opposite side of the of the self-adjusting bolt action skewer clamp mechanism of the present invention is adjustable. The adjustable side features a spring positioned within a clamping member, which in turn is axially movable relative to a frame of the bicycle trainer, and which is movable back and forth in response to a bolt action type actuator movably mounted to the frame. One end of the spring is engaged with a pin located within a passage defined by the clamping member, and the other end of the spring is engaged with a carrier contained within the clamping member. The bolt action actuator is secured to and extends outward from the carrier, such that the carrier is movable along with the actuator during movement of the actuator. In use, the actuator is helically rotated to advance the clamping member. This moves the carrier and the clamping member outwardly due to engagement of the spring between the carrier and the pin. When the outer end of the clamping member engages the end of the skewer, continued advancement of the actuator advances the carrier, which compresses the spring. Once the lever is fully rotated, it locks the bicycle axle into place. The spring compression accommodates variations in bicycle skewer lengths, which allows different sizes and styles of bikes to be mounted to the trainer without wasting time previously required for adjusting a clamping mechanism.

These and other features and aspects of the present invention will be better appreciated and understood when considered in conjunction with the following description and the accompanying drawings. It should be understood, however, that the following description, while indicating a representative embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
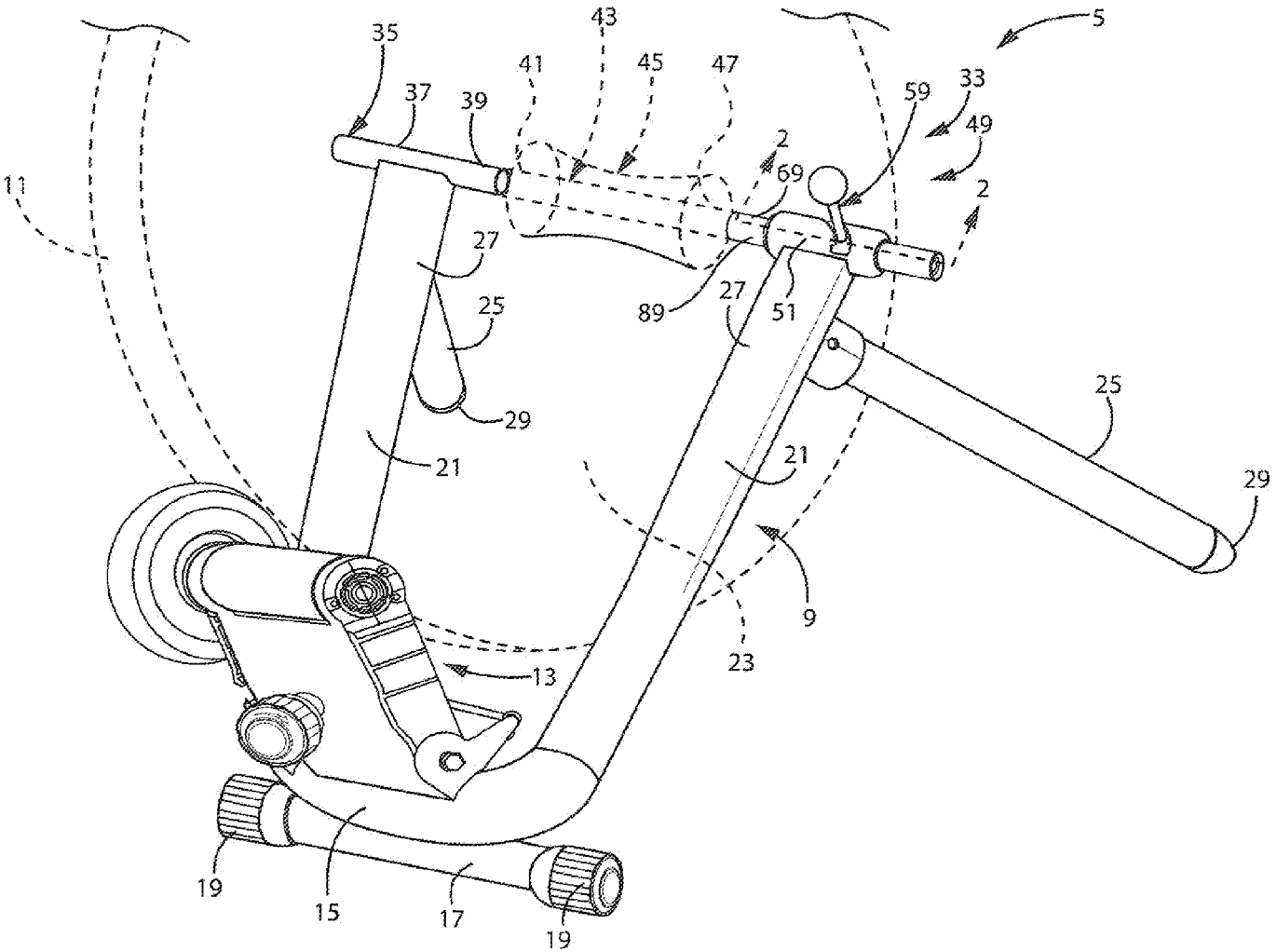
FIG. 1 is a perspective view of one embodiment of a bicycle trainer that features the self-adjusting bolt action skewer clamp of the present invention.

In describing the embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected, attached, or terms similar thereto are often used. They are not limited to direct connection but include connection through other elements where such connection is recognized as being equivalent by those skilled in the art.

DETAILED DESCRIPTION OF THE INVENTION

Specific embodiments of the present invention will be described by the following non-limiting examples which will serve to illustrate various features of the invention. With reference to the drawing figures in which like reference numerals designate like parts throughout the disclosure, a representative embodiment of the present invention is a bicycle trainer 5 that allows for stationary training on a bicycle. The bicycle trainer 5 includes a frame 9 that supports the bicycle in a stationary position while a user exerts a pedaling effort to rotate a driven wheel 11 of the bicycle during a training session, in a manner as is known, in which the rotation of the driven wheel is resisted by a resistance unit 13 that is arranged on the frame 9. The resistance unit 13 operates in a known way and can be one of an electronic, magnetic, fluid, or airflow-type resistance units such as those incorporated into various ones of the POWERBEAM PRO, SUPERMAGNETO PRO, JETFLUID PRO, FLUID2, MAGNETO, and WIND series trainers available from CycleOps POWER of Madison, Wis.

Still referring to FIG. 1, frame 9 is generally U-shaped and includes a lower segment 15 that is connected to a bar 17 that has a pair of rear feet 19 that engage the ground or other underlying support surface. A pair of side segments 21 extends from opposing ends of the lower segment 15 of the frame 9. The side segments 21 extend angularly from the lower segment 15 and bar 17. A space 23 is defined between the side segments 21 and in which the driven wheel 11 is arranged during use. Legs 25 extend downwardly from upper ends 27 of the frame side segments 21. Forward feet 29 are arranged at the lower ends 31 of the legs 25 and engage the ground or other underlying support surface. It is understood, however, that frame 9 may have any other configuration as desired.

Still referring to FIG. 1, a wheel support system 33 is arranged toward an upper portion of the frame 9 for mounting the driven wheel to the bicycle trainer 5. Wheel support system 33 includes a support 35 which is shown in this embodiment as a tube 37 that is connected to an upper end 27 of a side segment 21 of the frame 90 so that an inner end 39 is fixed in location relative to the frame 9. The inner end 39 of tube 37 engages and fixedly supports an end 41 of a skewer 43 that extends through and supports a hub 45 of the driven wheel 11. An opposite end 47 of the skewer 43 is supported by a clamp 49. In accordance with the present invention, clamp 49 is self-adjusting and actuates in a bolt action manner to secure the skewer 43 in the wheel support system 33.

Figure 2:
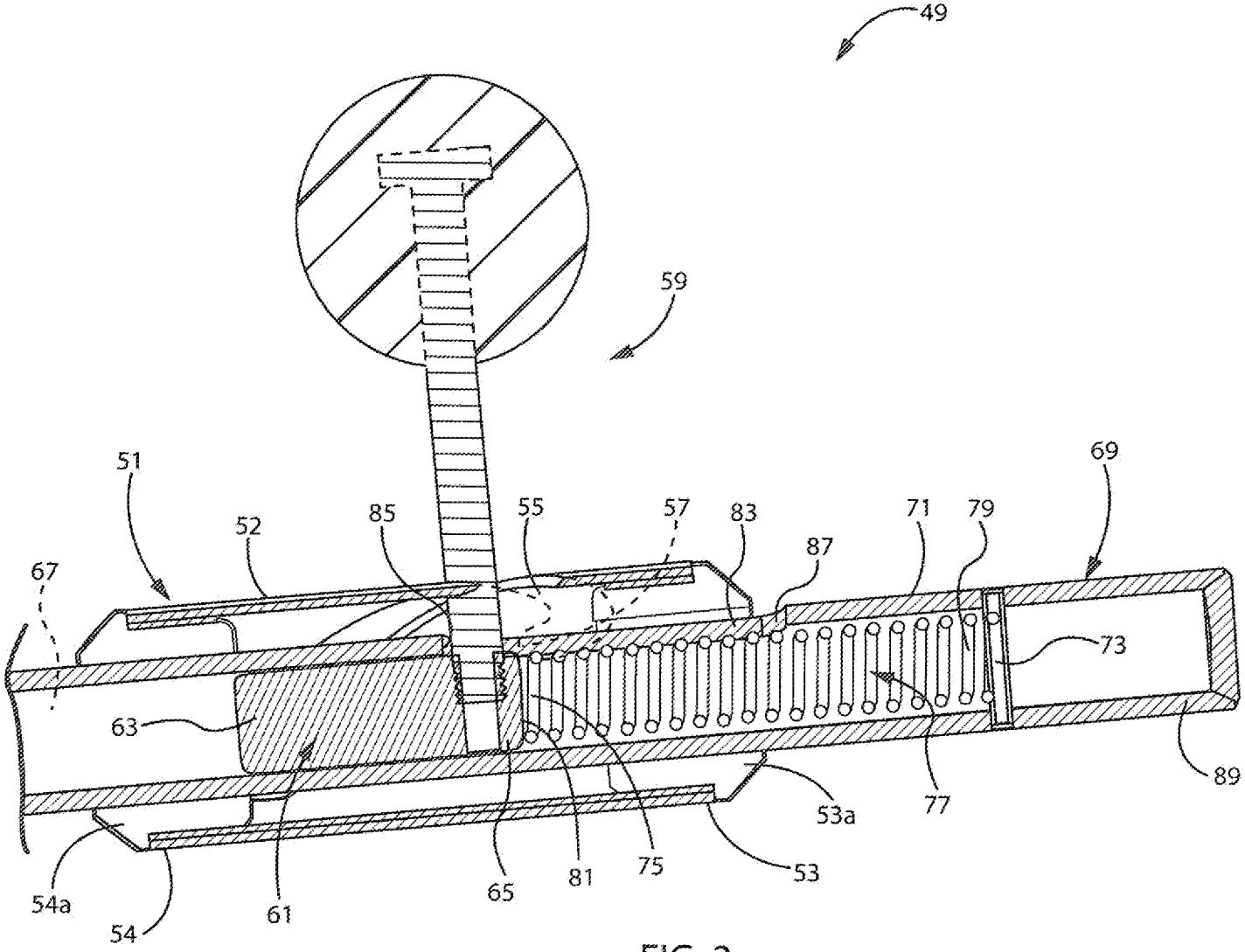
FIG. 2 is a partial cross section taken along line 2-2 of FIG. 1.

Referring now to FIG. 2, clamp 49 includes an outer tube 51 that is coaxially aligned with the tube 37 of the support 35 and is arranged on the upper end 27 of the other side segment 21. The outer tube 51 has a circumferential side wall 52 with opposing ends 53, 54. A slot 55 extends through the circumferential side wall 52 along a generally helical path. A pocket 57 extends from an inward end of the slot 55 that is closest to the driven wheel 11 (FIG. 1) and provides a recess in which a handle 59 that extends through the slot 55 can lock into to secure the handle 59 in a fixed position, in a bolt-action manner. The handle 59 is connected to a carrier 61 that is in the form of a cylindrical plug that includes opposing outer and inner ends 63, 65 and that is arranged concentrically inside and allowed to longitudinally translate within a space 67 inside of a clamping member, which may be in the form of an inner tube 69. The inner tube 69 is arranged concentrically inside of the outer tube 51 and is supported for siding longitudinal movement within the outer tube 51 at the opposing ends 53, 54 by way of bushings 53A, 54A. A circumferential side wall 71 of the inner tube 69 extends about the space 67. A pin 73 extends transversely through the tube 69 and engages and retains a first end 75 of a spring 77, which is contained within the passage defined by the inner tube 69. A second end 79 of the spring 77 is engaged with and supported by an end surface 81 at the inner end 65 of the carrier 61. The handle 59 extends through the slot 83 so that the carrier 61 and inner tube 69 can move relative to each other between two maximum travel positions. In one of the maximum travel positions, the inner tube 69 is fully extended with respect to the handle 59 so that the handle 59 abuts an outer end 85 of the slot 83. In the other of the maximum travel positions, the inner tube 69 is fully retracted with respect to the handle 59 so that the handle 59 abuts an inner end 87 of the slot 83.

Referring again to FIG. 1, in this arrangement, the clamp 49 can self-adjust the amount to which the inner tube 69 extends beyond the outer tube 51 and the clamping pressure against the skewer 43 (FIG. 1). That is because the spring 77 (FIG. 2) biases the inner tube 69 toward the fully extended position by pushing an inner end 89 of the inner tube 69 away from the carrier 61 (FIG. 2) and toward the end 47 of the skewer 43. The extent to which the inner tube 69 can extend toward the skewer 43 is limited by the distance between the outer tube 51 and the end 47 of the skewer 43 when the drive wheel 11 operably engages the resistance unit 13 and the end 42 skewer 43 abuts the inner end 39 of the tube 37 of the support 35. In this regard, the inner tube 69 can extend to different positions beyond the outer tube 51 when the handle 59 is in the locked position in the pocket 57 (FIG. 2), depending on the length of the skewer 43. Regardless of the length of the skewer 43, when the handle 59 is rotated into the locked position within the pocket 57, the inner end 89 of the inner tube 69 automatically obtains a proper position with respect to and engagement of the end 47 of skewer 43 by compressing the spring 77 relatively further for a relatively longer skewer 43 or by compressing the spring 77 relatively less far for a relatively shorter skewer 43.

Figure 3:
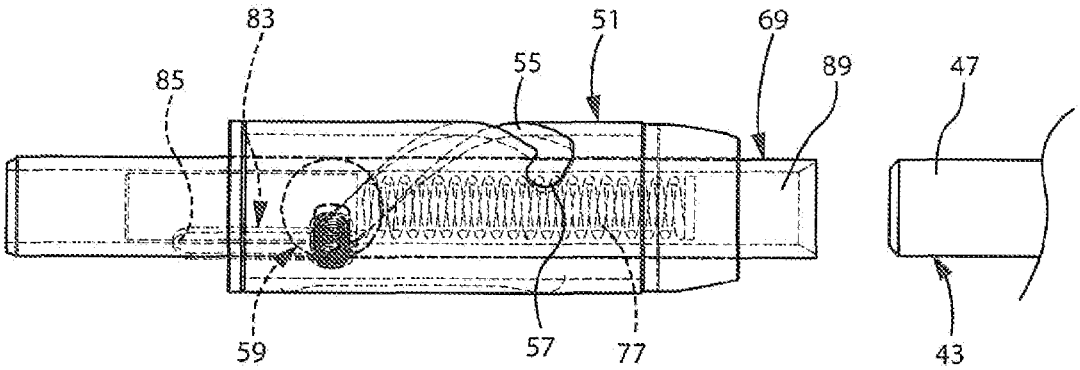
FIG. 3 is a partial elevation view of the self-adjusting bolt action skewer clamp FIG. 1 in an unlocked position.
Figure 4:
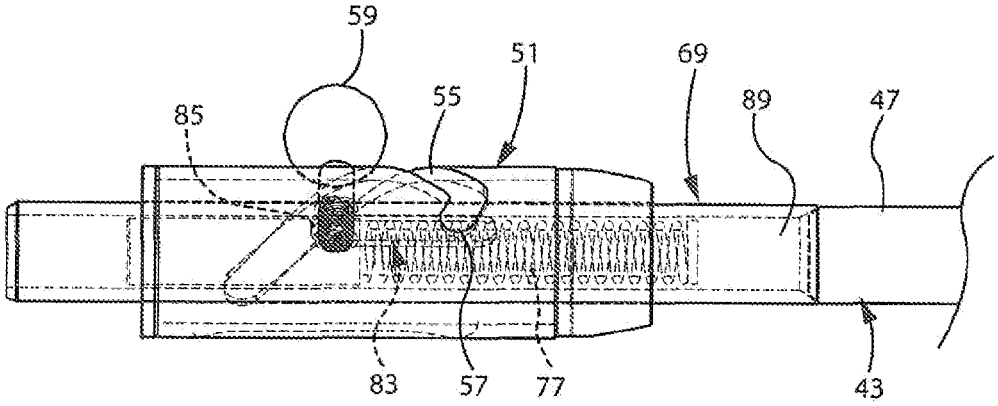
FIG. 4 is a a partial elevation view of the self-adjusting bolt action skewer clamp FIG. 1 in initial engagement position in which the end of the skewer is initially engaged.
Figure 5:
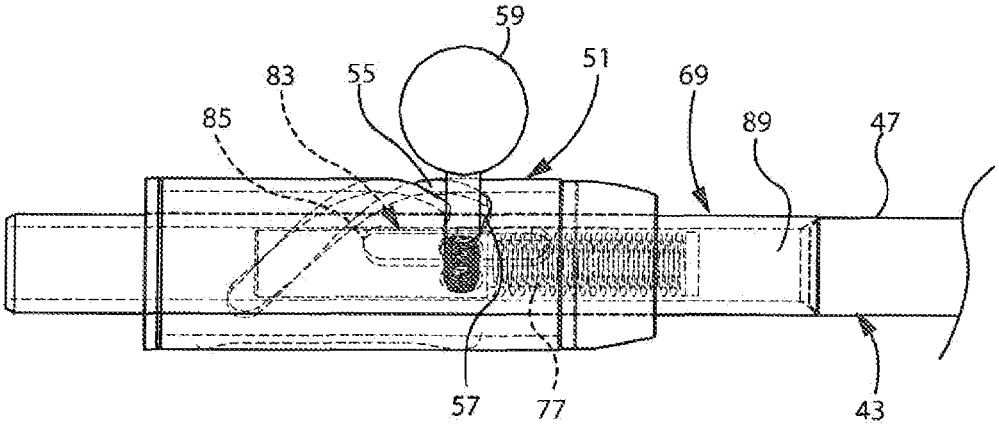
FIG. 5 is a partial elevation view of the self-adjusting bolt action skewer clamp FIG. 1 in a fully extended and locked position.

Referring now to FIGS. 3-5, the self-adjustment of the clamp 49 is shown in a schematic representation of a sequence of rotating the handle 59 into the locked position. In FIG. 3, the handle 59 is in an unlocked position and the inner tube 69 is spaced from the skewer 43. In FIG. 4, the handle 59 has been rotated so as to advance through the slot 55, helically along the outer tube 51, until the inner tube 69 first contacts the skewer 43. At this point, the inner tube 69 is in the fully extended position with respect to the carrier 61 so that the handle 59 is shown as being at the left-most position within and abutting the end 85 of the slot 83. In FIG. 5, the handle 59 has been fully rotated into the locked position in which the handle 59 is seated in the pocket 57 of slot 55. Even though the handle 59 shown in FIG. 5 has longitudinally advanced along the outer tube 51 when compared to the position of initial contact of the inner tube 69 and skewer 43 as shown in FIG. 4, and the inner tube 69 of FIG. 5 has rotated within the outer tube 51 relative to its position in FIG. 4, the inner tube 69 is in the same longitudinal position with respect to the outer tube 51. Accordingly, the handle 59 and carrier 61 have advanced relative to the inner tube 69 while moving from the positions of FIG. 4 to those of FIG. 5 by compressing the spring 77 to accommodate such relative movement. In this way, the clamp 49 can self-adjust to accommodate different skewers 43 of different lengths that vary in length by amounts that correspond to the length of slot 83 of the inner tube 69 so as to accommodate different size hubs 45 and driven wheels 11 of different bicycles used with the bicycle trainer 5.

Figure 6:
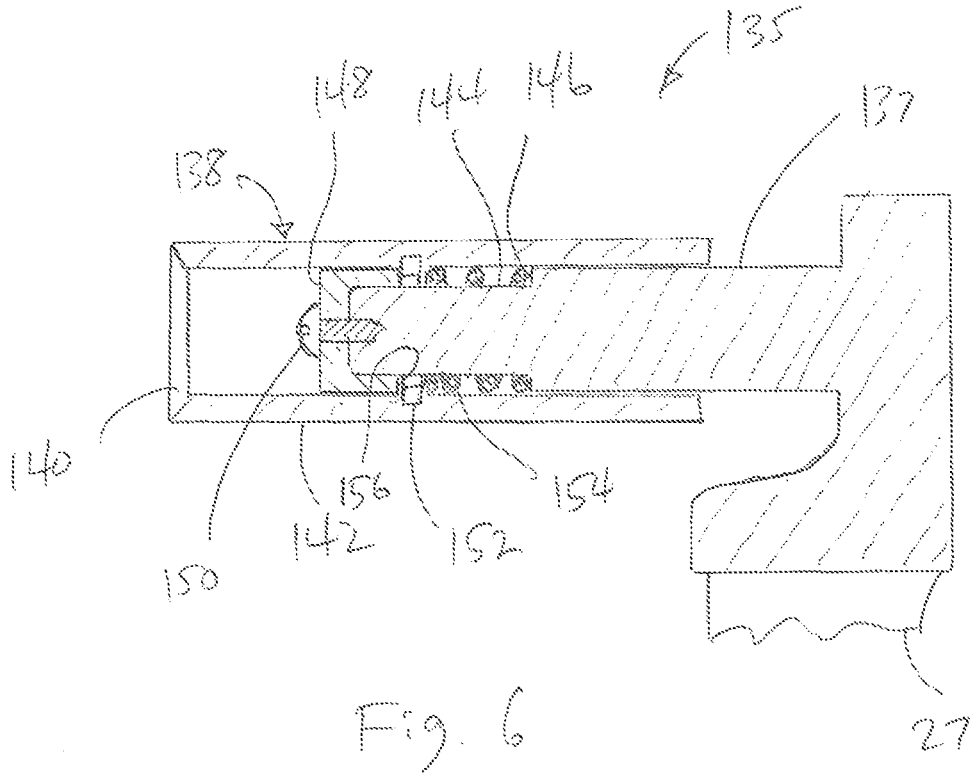
FIG. 6 is a partial cross-sectional view illustrating an alternative embodiment of the present invention.

FIG. 6 illustrates an alternative arrangement in accordance with the present invention, in which the self-adjusting skewer clamp feature is incorporated into the stationary side of the clamping arrangement, which is shown at 135. In this arrangement, the frame upper end 27 includes an inwardly extending post 137. A cylindrical receiver 138 is slidably mounted over post 137. Cylindrical receiver 138 includes an open end 140 that is configured to receive one end of a bicycle wheel skewer or axle, in a manner as is known, as well as a side wall 142. Post 137 defines a reduced diameter outer end portion 144 that terminates in a shoulder 146. A cap 148 is fitted over the end of reduced diameter end portion 144, and is configured to guide the outer portion of cylindrical receiver 138 during movement on post 137. Cap 148 may be secured to the end of reduced diameter end portion 144 in any satisfactory manner, such as by means of a screw 150 or the like. A snap ring 152 is engaged within the passage defined by cylindrical receiver 138 so as to define a stop surface, and a spring 154 is positioned between snap ring 152 and shoulder 146. With this arrangement, spring 154 biases cylindrical receiver 138 outwardly to a position in which snap ring 152 engages the inner end surface of 148, which is shown at 156. When the actuator of the clamping mechanism is operated to initiate a clamping action on the bicycle skewer or axle, the end of the skewer or axle that is received by the open end 140 of cylindrical receiver 138 exerts a force on cylindrical receiver 138 in an outward direction, i.e. toward the frame 27. This force causes outward movement of snap ring 152, which functions to compress spring 154. Spring 154 continues to apply an outward bias on cylindrical receiver 138 in order to provide a secure clamping force on the bicycle axle or skewer during use. When the actuator of the clamping mechanism is moved so as to relieve the clamping force on the bicycle axle or skewer, spring 154 functions to return cylindrical receiver 138 to its outwardmost most position in which snap ring 152 is engaged with end surface 156 of cap 148.

It can thus be appreciated that the self-adjusting feature of the skewer or axle clamp of the present invention can be incorporated in either the actuating portion of the clamping mechanism or in the receiving portion of the clamping mechanism, or both. In addition, it can be appreciated that the self-adjusting feature of the skewer or axle clamp of the present invention may be employed with an type of actuator mechanism, and is not limited to use in combination with a bolt action-type actuator mechanism as described above.

Various alternatives and embodiments are contemplated as being within the scope of the following claims particularly pointing out and distinctly claiming the subject matter regarded as the invention.

We claim:

1. A bicycle trainer, comprising:

a frame that can support a bicycle in a stationary position while a user exerts a pedaling effort to rotate a driven wheel of the bicycle during a training session and a resistance unit that can cooperate with the driven wheel of the bicycle so as to resist the pedaling effort of the user, the frame including a pair of side segments that are spaced from each other, each of the side segments including an upper end, and a wheel support system that is arranged at the upper ends of the side segments for supporting the driven wheel, the wheel support system including:

a first wheel engagement arrangement interconnected with a first one of the side segments of the frame;

a second wheel engagement arrangement interconnected with a second one of the side segments of the frame;

an actuation arrangement associated with at least one of the first and second wheel engagement arrangements for selectively moving the first and second wheel engagement arrangements toward each other to an engaged position in which the driven wheel is retained therebetween, and apart from each other to a release position in which the driven wheel is released; and a movable biasing arrangement associated with one of the first and second wheel engagement arrangements, wherein the movable biasing arrangement comprises a spring that applies an outward biasing force on the associated wheel engagement arrangement that urges the associated wheel engagement arrangement toward an extended position, and wherein the spring is compressible upon engagement with the driven wheel so as to accommodate different wheel widths, and wherein the spring is configured and arranged to apply the biasing force to the driven wheel through the associated wheel engagement arrangement and wherein the biasing force of the spring clamps the driven wheel between the first and second wheel engagement arrangements when the first and second wheel engagement arrangements are in the engaged position.

2. The bicycle trainer of claim 1, wherein the actuation arrangement selectively moves the first wheel engagement arrangement toward and away from the driven wheel, and wherein the spring is associated with the first wheel engagement arrangement.

3. The bicycle trainer of claim 1, wherein the first wheel engagement arrangement includes the actuation arrangement and the second wheel engagement arrangement includes a receiver, and wherein the spring is associated with the second wheel engagement arrangement.

4. The bicycle trainer of claim 2, wherein the first wheel engagement arrangement includes:

an outer support member that is fixed with respect to the frame and that includes a side wall that extends about a longitudinally extending internal opening and a slot that extends through the outer support member side wall and into the internal opening;

an inner clamping member that is arranged within the internal opening of the outer support member so that the inner clamping member can move through the internal opening to extend beyond the outer support member for supporting the driven wheel; and wherein the actuation arrangement includes a handle for moving the inner clamping member relative to the outer support member, the handle being movable with respect to the outer support member for selectively moving the first wheel engagement arrangement between the engaged and release positions and being movable with respect to the inner clamping member so that the inner clamping member can automatically adjust to different positions beyond the outer support member when the first wheel engagement arrangement is in the engaged position.

5. The bicycle trainer of claim 4, wherein a slot extends longitudinally through the inner clamping member and wherein the handle extends through the slot of the inner clamping member so the handle is movable between a fully advanced position and a fully retracted position.

6. The bicycle trainer of claim 5, wherein the spring is arranged to bias the inner clamping member toward the extended position when the first wheel engagement arrangement is in the engaged position.

7. The bicycle trainer of claim 6, wherein the wheel support system includes a carrier that is arranged inside of the inner clamping member and that can move longitudinally within the inner clamping member, wherein the handle is connected to the carrier so that the handle and carrier move in unison with each other, and wherein movement of the handle and carrier with respect to the inner clamping member can increase a biasing force applied by the spring to the inner clamping member.

8. The bicycle trainer of claim 7, wherein the carrier is generally cylindrical and has an inner end that faces inwardly with respect to the bicycle trainer and an outer end that faces outwardly with respect to the bicycle trainer, and wherein the handle is connected to the inner end of the carrier and the inner end of the carrier defines a surface that engages a first end of the spring.

9. A bicycle trainer, comprising:

a frame that can support a bicycle in a stationary position while a user exerts a pedaling effort to rotate a driven wheel of the bicycle during a training session and a resistance unit that can cooperate with the driven wheel of the bicycle so as to resist the pedaling effort of the user, the frame including a pair of side segments that are spaced from each other, each of the side segments including an upper end, and a wheel support system that is arranged at the upper ends of the side segments for supporting the driven wheel, the wheel support system including, a first skewer engagement member on a first one of the side segments;

a second skewer engagement member on a second one of the side segments;

wherein one of the skewer engagement members is movable toward and away from the other in response to operation of an actuator for clamping a bicycle skewer therebetween when the actuator is in an engaged position; and wherein one of the skewer engagement members includes a compressible spring that accommodates skewers of differing lengths without adjustment of the skewer engagement member relative to the side segment, wherein the spring applies an outward biasing force on the skewer engagement member that urges the skewer engagement member toward an extended position, and wherein the spring is compressible upon engagement with the skewer so as to accommodate different skewer lengths, and wherein the spring applies the biasing force to the skewer through the skewer engagement member and wherein the biasing force of the spring clamps the skewer between the first and second skewer engagement members then the actuator is in the engaged position.

10. A method of using a bicycle trainer, comprising:

resting a bicycle within a frame of a bicycle trainer that can support a bicycle while a user exerts a pedaling effort to rotate a bicycle wheel;

positioning the bicycle wheel adjacent a resistance unit; and engaging an axle of the bicycle wheel with a wheel support system by moving an actuator toward an engaged position, wherein the actuator is connected to a clamping member and movement of the actuator toward the engaged position functions to move the clamping member toward a receiving member, and selectively compressing a spring associated with one of the clamping member and the receiving member upon movement of the actuator toward the engaged position, wherein compression of the spring functions to apply an outward biasing force on the associated one of the clamping member and the receiving member that urges the associated one of the clamping member and the receiving member toward an extended position, and wherein the spring is compressible upon engagement with the axle so as to accommodate axles of different lengths, and wherein the spring applies the biasing force to the axle through the associated one of the clamping member and the receiving member and wherein the biasing force of the spring clamps the axle between the clamping member and the receiving member when the actuator is in the engaged position.

11. The method of claim 10, wherein the step of selectively compressing a spring is carried out via a spring arrangement associated with the clamping member.

12. The method of claim 10, wherein the step of selectively compressing a spring is carried out via a spring arrangement associated with the receiving member.

13. The method of claim 10, wherein the actuator includes a handle movable within a helical slot, wherein the actuator includes an inner clamping member that functions to selectively compress the spring.

14. The method of claim 13, wherein the spring is located within a passage defined by the inner clamping member.

* * * * *